US009351593B1

(12) United States Patent
Little

(10) Patent No.: US 9,351,593 B1
(45) Date of Patent: May 31, 2016

(54) PICTURE/MIRROR SYSTEM

(71) Applicant: Anthony A. Little, Odessa, FL (US)

(72) Inventor: Anthony A. Little, Odessa, FL (US)

( * ) Notice: Subject to any disclaimer, the term of this patent is extended or adjusted under 35 U.S.C. 154(b) by 0 days.

(21) Appl. No.: 14/587,914

(22) Filed: Dec. 31, 2014

(51) Int. Cl.
*A47G 1/06* (2006.01)
*A47G 1/02* (2006.01)

(52) U.S. Cl.
CPC *A47G 1/065* (2013.01); *A47G 1/02* (2013.01); *A47G 1/0622* (2013.01)

(58) Field of Classification Search
CPC ..... A47G 1/0622; A47G 1/065; A47G 2001/0694
See application file for complete search history.

(56) References Cited

U.S. PATENT DOCUMENTS

| | | | | |
|---|---|---|---|---|
| 1,930,244 | A * | 10/1933 | Lewinsohn et al. | 362/129 |
| 2,086,443 | A * | 7/1937 | Rutyna | 40/733 |
| 2,406,729 | A * | 8/1946 | White et al. | 160/119 |
| 2,485,814 | A * | 10/1949 | Cohan | 132/301 |
| 2,826,844 | A * | 3/1958 | Leika | 40/124.02 |
| 5,605,354 | A * | 2/1997 | Kwon | 281/22 |
| 6,230,428 | B1 * | 5/2001 | Albin | 40/730 |
| 6,536,148 | B2 * | 3/2003 | Heiliger | 40/721 |
| 2004/0134111 | A1 * | 7/2004 | Berg | 40/721 |
| 2004/0226209 | A1 * | 11/2004 | Ayala | 40/714 |
| 2012/0079751 | A1 * | 4/2012 | Singer | 40/359 |
| 2012/0320622 | A1 * | 12/2012 | Sanders | 362/602 |

* cited by examiner

*Primary Examiner* — Gary Hoge

(57) ABSTRACT

A first frame has a top edge and a bottom edge, and a left edge and a right edge, and an exterior face and an interior face. A first picture is on the exterior face of the first frame. A second picture is on the interior face of the first frame. A second frame has a top edge and a bottom edge, and a left edge and a right edge, and an exterior face and an interior face. A first mirror is on the interior face of the second frame. A support leg is pivotably supported on the exterior face of the second frame for resting the system on a horizontal counter top.

2 Claims, 5 Drawing Sheets

PICTURE/MIRROR SYSTEM

BACKGROUND OF THE INVENTION

1. Field of the Invention

The present invention relates to a picture/mirror system and more particularly pertains to displaying a single picture when in a primary mode and for displaying a picture while presenting a mirror when in a secondary mode.

2. Description of the Prior Art

The use of pictures and mirrors and frames is known in the prior art. More specifically, pictures and mirrors and frames previously devised and utilized for the purpose of displaying pictures and for presenting mirrors are known to consist basically of familiar, expected, and obvious structural configurations, notwithstanding the myriad of designs encompassed by the crowded prior art which has been developed for the fulfillment of countless objectives and requirements.

While known devices fulfill their respective, particular objectives and requirements, the prior art does not describe a picture/mirror system that allows displaying a single picture when in a primary mode and for displaying a picture while presenting a mirror when in a secondary mode.

In this respect, the picture/mirror system according to the present invention substantially departs from the conventional concepts and designs of the prior art, and in doing so provides an apparatus primarily developed for the purpose of displaying a single picture when in a primary mode and for displaying a picture while presenting a mirror when in a secondary mode.

Therefore, it can be appreciated that there exists a continuing need for a new and improved picture/mirror system which can be used for displaying a single picture when in a primary mode and for displaying a picture while presenting a mirror when in a secondary mode. In this regard, the present invention substantially fulfills this need.

SUMMARY OF THE INVENTION

In view of the foregoing disadvantages inherent in the known types of pictures and mirrors and frames now present in the prior art, the present invention provides an improved picture/mirror system. As such, the general purpose of the present invention, which will be described subsequently in greater detail, is to provide a new and improved picture/mirror system and method which has all the advantages of the prior art and none of the disadvantages.

To attain this, the present invention essentially comprises a first frame. The first frame has a top edge and a bottom edge, and a left edge and a right edge, and an exterior face and an interior face. A first picture is on the exterior face of the first frame. A second picture is on the interior face of the first frame. A second frame has a top edge and a bottom edge, and a left edge and a right edge, and an exterior face and an interior face. A first mirror is on the interior face of the second frame. A support leg is pivotably received on the exterior face of the second frame for resting the system on a horizontal counter top.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved picture/mirror system which has all of the advantages of the prior art pictures and mirrors and frames and none of the disadvantages.

It is another object of the present invention to provide a new and improved picture/mirror system which may be easily and efficiently manufactured and marketed.

It is further object of the present invention to provide a new and improved picture/mirror system which is of durable and reliable constructions.

An even further object of the present invention is to provide a new and improved picture/mirror system which is susceptible of a low cost of manufacture with regard to both materials and labor, and which accordingly is then susceptible of low prices of sale to the consuming public, thereby making such picture/mirror system economically available to the buying public.

Even still another object of the present invention is to provide a picture/mirror system for displaying a single picture when in a primary mode and for displaying a picture while presenting a mirror when in a secondary mode.

Lastly, it is an object of the present invention to provide a first frame having a top edge and a bottom edge, and a left edge and a right edge and an exterior face and an interior face. A first picture is on the exterior face of the first frame. A first mirror is on the interior face of the first frame. A second frame has a top edge and a bottom edge, and a left edge and a right edge and an exterior face and an interior face. A second picture is on the interior face of the second frame. A support leg is pivotably secured to the exterior face of the second frame for resting the system on a horizontal counter top. A hinge is pivotably coupling the right edge of the first frame and the left edge of the second frame.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
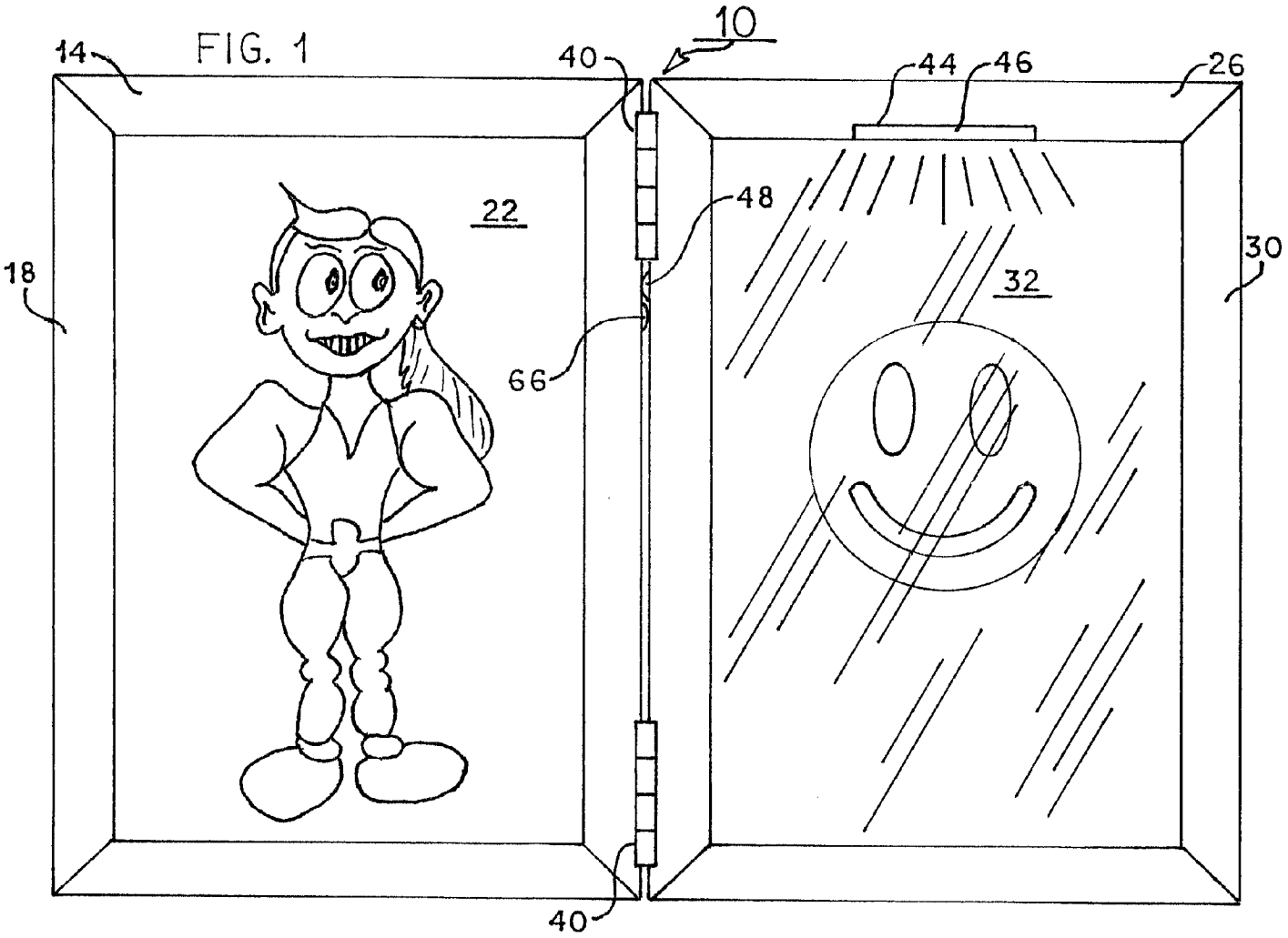
FIG. 1 is a front elevational view of the interior faces of the first and second frames showing a picture and a mirror.
Figure 3:
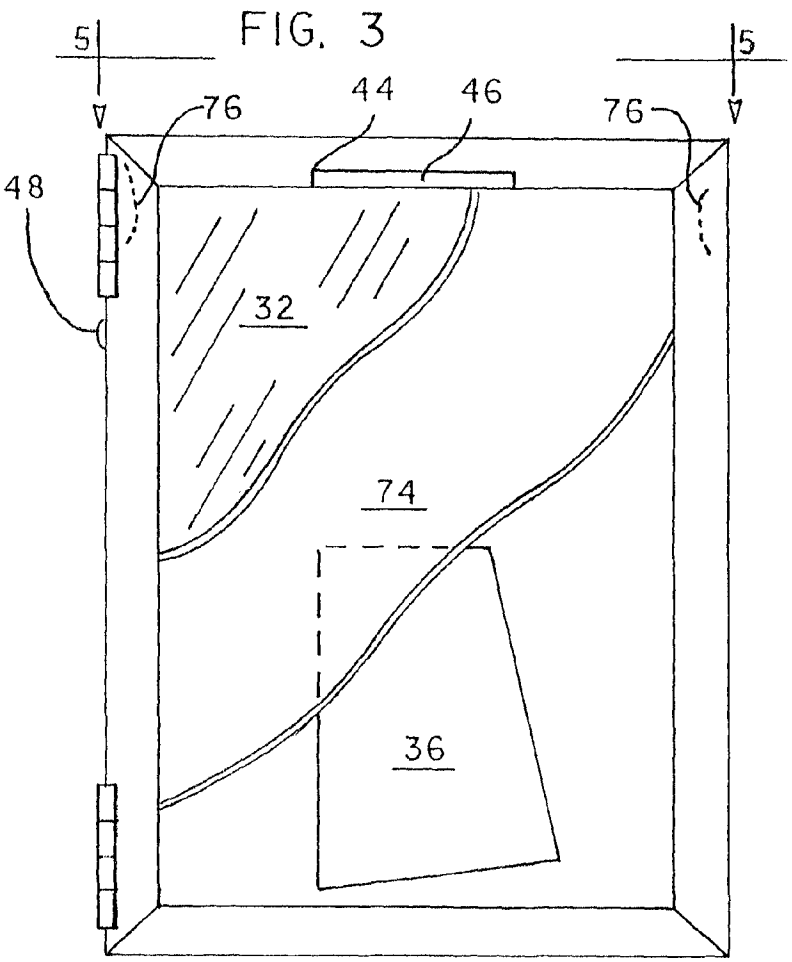
FIGS. 2 and 3 are front elevational views, partially broken away, of the exterior surfaces of the first and second frames.
Figure 2:
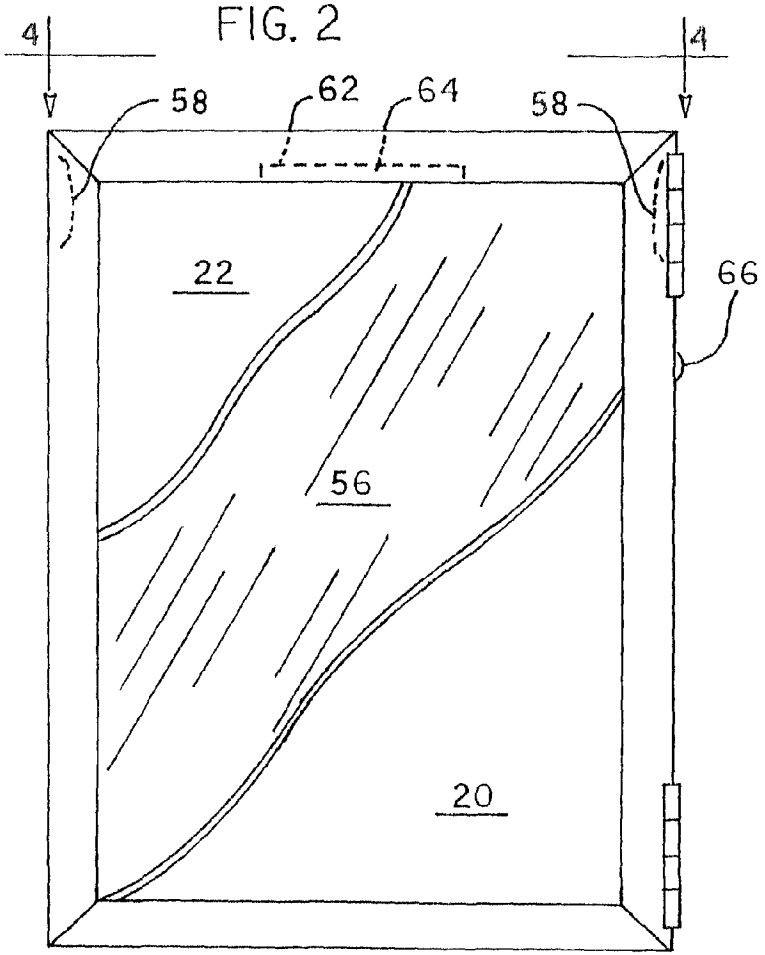
Figure 4:
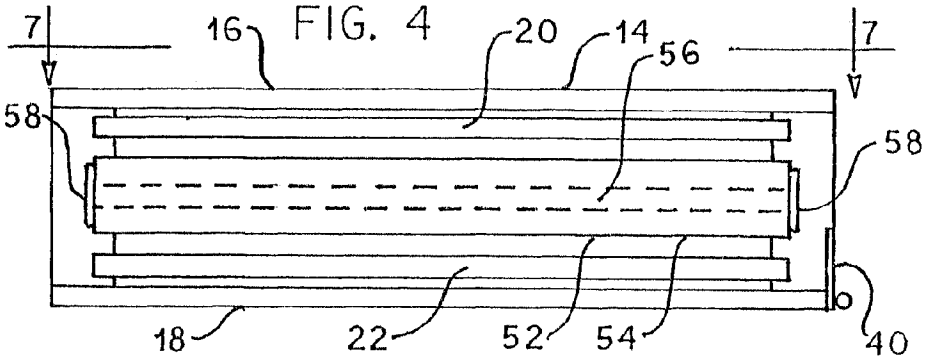
FIGS. 4 and 5 are plan views of the first and second frames.
Figure 5:
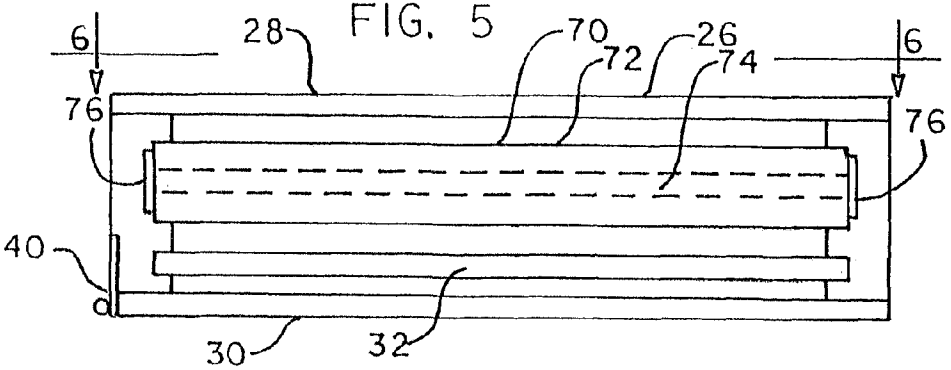
Figures 6, 7:
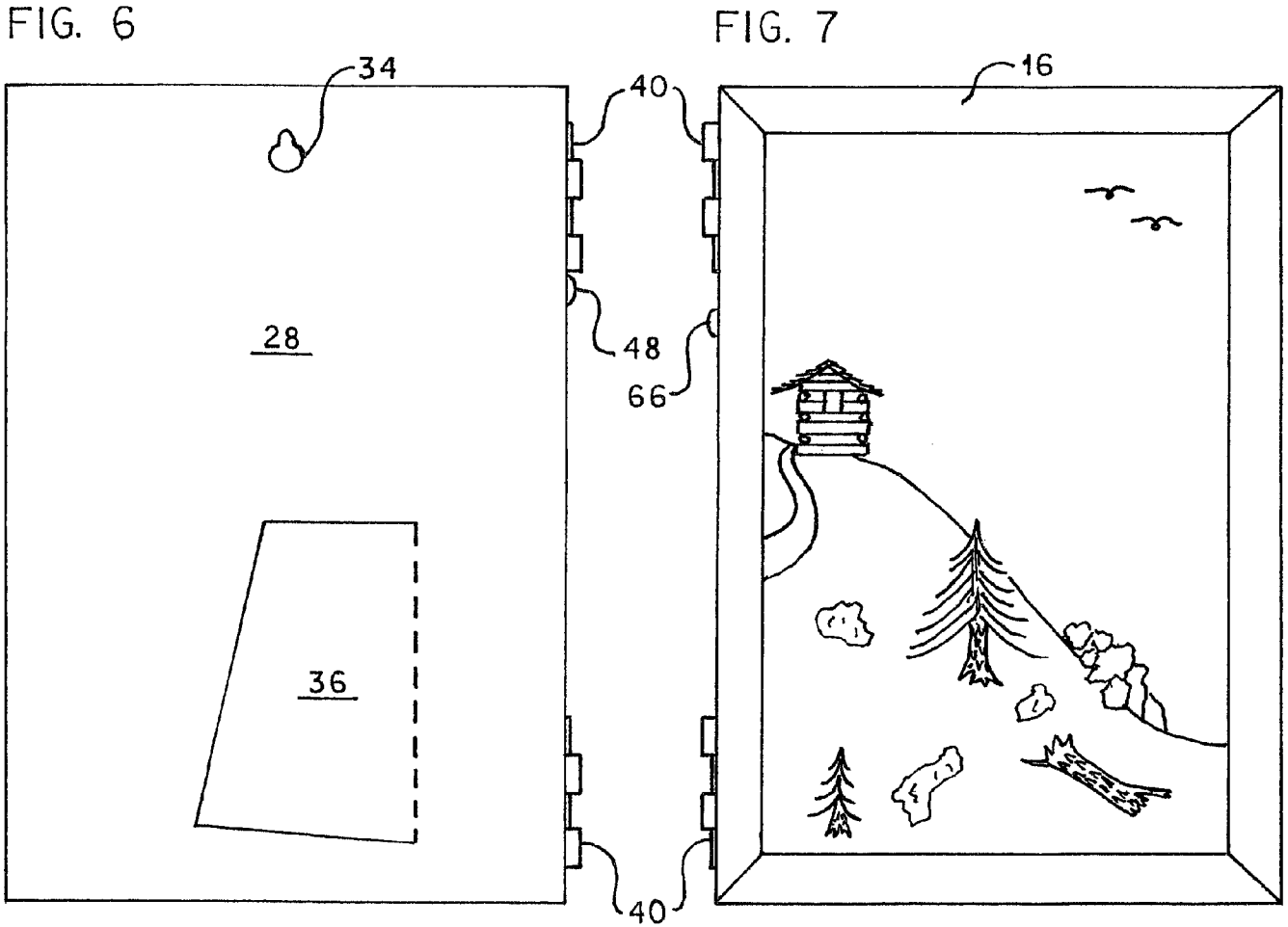
FIGS. 6 and 7 are front elevational views of the exterior faces of the first and second frames showing a picture and supports.
Figure 8:
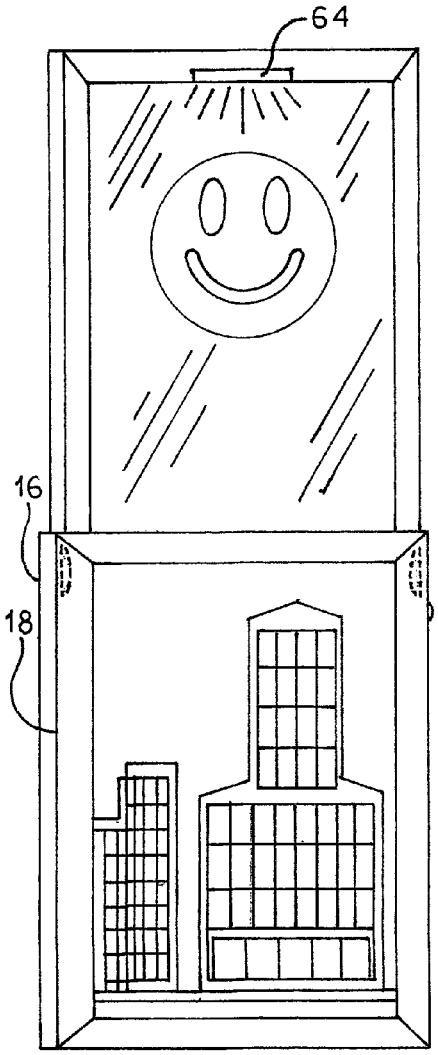
FIG. 8 is a front elevational view of the interior face of the first frame with the second mirror extending upwardly above the second picture.
Figure 9:
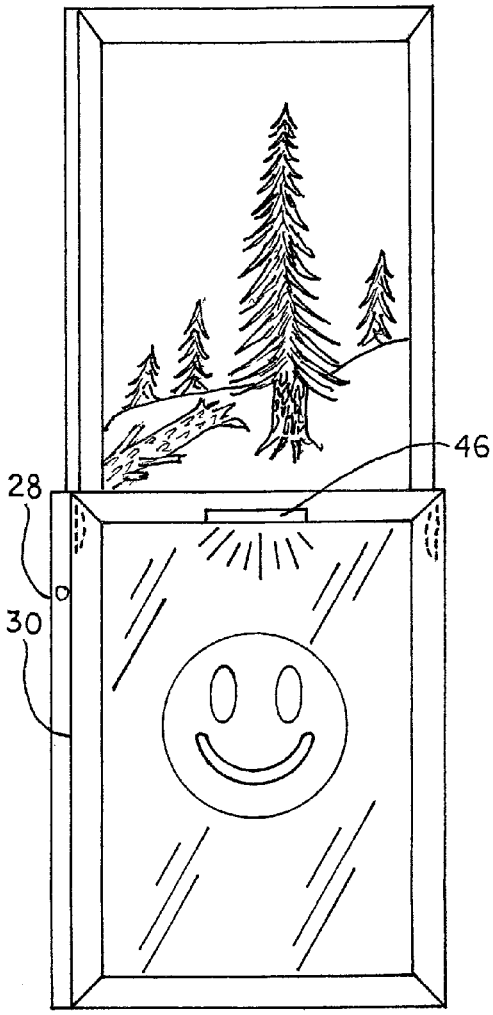
FIG. 9 is a front elevational view of the interior face of the second frame with the third picture extending upwardly from the first mirror.

With reference now to the drawings, and in particular to FIG. 1 thereof, the preferred embodiment of the new and improved picture/mirror system embodying the principles and concepts of the present invention and generally designated by the reference numeral 10 will be described. From a broad view point, the picture/mirror system of the present invention includes a first frame. The first frame has a top edge and a bottom edge, and a left edge and a right edge, and an exterior face and an interior face. A first picture is on the exterior face of the first frame. A second picture is on the interior face of the first frame. A second frame has a top edge and a bottom edge, and a left edge and a right edge, and an exterior face and an interior face. A first mirror is on the interior face of the second frame. A support leg is pivotably secured to the exterior face of the second frame for resting the system on a horizontal counter top. Such components are individually configured and correlated with respect to each other so as to attain the desired objective.

The present invention, more specifically, is a picture/mirror system 10 for displaying a single picture when in a primary mode and for displaying a picture while presenting a mirror when in a secondary mode. The converting between the primary and secondary modes is done in a convenient and economical manner. The system includes a first frame 14 having a rectangular configuration with a top edge and a bottom edge. The first frame has a left edge and a right edge. The first frame has an exterior face 16 and an interior face 18. A first picture 20 is on the exterior face of the first frame. A second picture 22 is on the interior face of the first frame.

The system includes a second frame 26 having a rectangular configuration with a top edge and a bottom edge. The second frame has a left edge and a right edge. The second frame has an exterior face 28 and an interior face 30. A first mirror 32 is on the interior face of the second frame. An aperture 34 is in the exterior face of the second frame for hanging the system on a vertical wall. A support leg 36 is pivotably secured to the exterior face of the second frame for resting the system on a horizontal counter top.

Next provided is a hinge 40 pivotably coupling the right edge of the first frame and the left edge of the second frame. The hinge is adapted to allow movement of the first frame and the second frame between the primary mode and the secondary mode. The primary mode is with the interior face of the first frame in facing contact with the interior face of the second frame and the system is hanging from the wall. The secondary mode is with the lower edges of the first and second frames resting on the counter top. The secondary mode is with the first frame being at an angle of between 90 degrees and 180 degrees with respect to the second frame.

A first recess 44 is in the interior face of the second frame adjacent to the top edge. A first light 46 is in the first recess to illuminate the first mirror. The first recess with the first light are configured and oriented to abate interference between the interior faces of the first and second frames when in the primary mode. A first switch 48 is positioned intermediate the first and second frames. The first switch is adapted to inactivate the first light when in the primary mode. The first switch is adapted to activate the first light when not in the primary mode.

A first chamber 52 is formed in the first frame. A first slot 54 is in the top edge of the first frame in communication with the first chamber. A second mirror 56 is in the first chamber adapted to be moved between a lower position and an upper position. The lower position is in back of the second picture. The second position is elevated above the second picture. A first spring finger 58 is adapted to hold the second mirror in the upper position.

A second recess 62 is formed in the second mirror. A second light 64 is in the second recess to illuminate the second mirror. The second recess with the second light are configured and oriented to abate interference between the second mirror and the first frame when in the lower position. A second switch 66 is positioned intermediate the second mirror and the first frame. The second switch is adapted to inactivate the second light when in the lower position. The second switch is adapted to activate the second light when not in the lower position.

Lastly, a second chamber 70 is in the second frame. A second slot 72 is in the top edge of the second frame in communication with the second chamber. A third picture 74 is in the second chamber adapted to be moved between a lower position and an upper position. The lower position being in back of the first mirror. The second position is elevated above the first mirror. A second spring finger 76 is adapted to hold the third picture in the upper position. It should be understood that a plurality of pictures couplable to at least one of the frames may be included in the system.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A picture/mirror system comprising:

a first frame having a top edge and a bottom edge, and a left edge and a right edge, and an exterior face and an interior face;

a first picture on the exterior face of the first frame;

a second picture on the interior face of the first frame;

a second frame having a top edge and a bottom edge, and a left edge and a right edge, and an exterior face and an interior face;

a first mirror on the interior face of the second frame;

a support leg pivotably secured the exterior face of the second frame for resting the system on a horizontal counter top;

a hinge pivotably coupling the right edge of the first frame and the left edge of the second frame;

a first chamber formed in the first frame, a first slot in the top edge of the first frame in communication with the first chamber, a second mirror in the first chamber adapted to be moved between a lower position and an upper position, the lower position being in back of the second picture, the second position being elevated above the second picture, a first spring finger adapted to hold the second mirror in the upper position; and a second chamber formed in the second frame, a second slot in the top edge of the second frame in communication with the second chamber, a third picture in the second chamber adapted to be moved between a lower position and an upper position, the lower position being in back of the first mirror, the second position being elevated above the first mirror, a second spring finger adapted to hold the third picture in the upper position.

2. A picture/mirror system (10) for displaying a single picture when in a primary mode and for displaying a picture while presenting a mirror when in a secondary mode, the converting between the primary and secondary modes being done in a convenient, and economical manner, the system comprising, in combination:

a first frame (14) having a rectangular configuration with a top edge and a bottom edge, and a left edge and a right edge, and an exterior face (16) and an interior face (18);

a first picture (20) on the exterior face of the first frame;

a second picture (22) on the interior face of the first frame;

a second frame (26) having a rectangular configuration with a top edge and a bottom edge, and a left edge and a right edge, and an exterior face (28) and an interior face (30);

a first mirror (32) on the interior face of the second frame;

an aperture (34) in the exterior face of the second frame for hanging the system on a vertical wall;

a support leg (36) pivotably secured to the exterior face of the second frame for resting the system on a horizontal counter top;

a hinge (40) pivotably coupling the right edge of the first frame and the left edge of the second frame, the hinge adapted to allow movement of the first frame and the second frame between the primary mode and the secondary mode, the primary mode being with the interior face of the first frame in facing contact with the interior face of the second frame and the system hanging from the wall, the secondary mode being with the lower edges of the first and second frames resting on the counter top, the secondary mode being with the first frame being at an angle of between 90 degrees and 180 degrees with respect to the second frame;

a first recess (44) formed in the interior face of the second frame adjacent to the top edge, a first light (46) in the first recess to illuminate the first mirror, the first recess with the first light being configured and oriented to abate interference between the interior faces of the first and second frames when in the primary mode, a first switch (48) located intermediate the first and second frames adapted to inactivate the first light when in the primary mode, the first switch adapted to activate the first light when not in the primary mode;

a first chamber (52) formed in the first frame, a first slot (54) in the top edge of the first frame in communication with the first chamber, a second mirror (56) in the first chamber adapted to be moved between a lower position and an upper position, the lower position being in back of the second picture, the upper position being elevated above the second picture, a first spring finger (58) adapted to hold the second mirror in the upper position;

a second recess (62) in the second mirror, a second light (64) in the second recess to illuminate the second mirror, the second recess with the second light being configured and oriented to abate interference between the second mirror and the second frame when in the lower position, a second switch (66) positioned intermediate the second mirror and the first frame adapted to inactivate the second light when in the lower position, the second switch adapted to activate the second light when not in the lower position; and a second chamber (70) in the second frame, a second slot (72) in the top edge of the second frame in communication with the second chamber, a third picture (74) in the second chamber adapted to be moved between a lower position and an upper position, the lower position being in back of the first mirror, the second position being elevated above the first mirror, a second spring finger (76) adapted to hold the third picture in the upper position.

* * * * *